US006381917B1

(12) United States Patent
Thielow et al.

(10) Patent No.: US 6,381,917 B1
(45) Date of Patent: May 7, 2002

(54) LIFT DOOR PANEL

(75) Inventors: Frank Thielow, Bodnegg; Harald Feistenauer, Isny, both of (DE)

(73) Assignee: Inventio AG, Hergiswil (CH)

( * ) Notice: Subject to any disclaimer, the term of this patent is extended or adjusted under 35 U.S.C. 154(b) by 0 days.

(21) Appl. No.: 09/657,034

(22) Filed: Sep. 7, 2000

(30) Foreign Application Priority Data

Sep. 8, 1999 (EP) ..... 99117684

(51) Int. Cl.[7] ..... E04C 2/08

(52) U.S. Cl. ..... 52/784.1; 52/232; 52/1; 52/784.11; 52/784.12; 52/DIG. 5

(58) Field of Search ..... 52/783.13, 784.1, 52/784.11, 784.12, 784.15, 746.1, 232, 783.12, DIG. 5, 745.21, 291, 1

(56) References Cited

U.S. PATENT DOCUMENTS

| | | | | | |
|---|---|---|---|---|---|
| 918,824 | A | * | 4/1909 | Caywood | 52/784.11 |
| 1,204,074 | A | * | 11/1916 | Saino | 52/232 |
| 1,257,476 | A | * | 2/1918 | Gervais | 52/784.11 |
| 1,895,553 | A | * | 1/1933 | Nordell | 52/232 |
| 2,003,618 | A | * | 6/1935 | White | 52/746 |
| 2,196,781 | A | * | 4/1940 | Saino et al. | 52/232 |
| 2,863,503 | A | * | 12/1958 | Stroup | 52/291 |
| 3,104,699 | A | * | 9/1963 | Wolf et al. | 52/232 |
| 3,740,916 | A | * | 6/1973 | Kenaga | 52/629 |
| 3,981,102 | A | * | 9/1976 | Harwood et al. | 49/501 |
| 4,008,745 | A | * | 2/1977 | Bailey | 160/229 R |
| 4,182,080 | A | * | 1/1980 | Naylor | 49/410 |
| 4,499,703 | A | * | 2/1985 | Rundo | 52/746 |
| 4,811,538 | A | * | 3/1989 | Lehnert et al. | 52/455 |
| 4,845,910 | A | * | 7/1989 | Hanson et al. | 52/288 |
| 5,293,726 | A | * | 3/1994 | Schick | 52/455 |
| 5,612,111 | A | * | 3/1997 | Lin | 428/71 |
| 6,092,343 | A | * | 7/2000 | West et al. | 52/309.11 |
| 6,186,469 | B1 | * | 2/2001 | Scott | 249/16 |

FOREIGN PATENT DOCUMENTS

| | | | | |
|---|---|---|---|---|
| DE | 1 683 420 | | 1/1971 | |
| DE | 2919454 | * | 11/1980 | 52/232 |
| DE | 1 964 5517 A1 | | 4/1998 | |
| EP | 0 516 961 A1 | | 12/1942 | |
| EP | 252901 | * | 1/1988 | 52/232 |
| FR | 1482112 | | 4/1967 | |

* cited by examiner

*Primary Examiner*—Carl D. Friedman
*Assistant Examiner*—Phi Dieu Tran A
(74) *Attorney, Agent, or Firm*—Schweitzer Cornman Gross & Bondell LLP

(57) ABSTRACT

A lift door panel which, apart from a good sound and vibration damping with a high degree of rigidity, is producible to be largely distortion-free, wherein a warping in the case of fire and under high heat effect is reduced or avoided. The door panel has a front and back wall which are connected together by a first connection which is releasable under the action of heat and has at least a second heat-resistant connection.

15 Claims, 5 Drawing Sheets

LIFT DOOR PANEL

BACKGROUND OF THE INVENTION

Numerous safety requirements are imposed on lift or elevator doors, which requirements have to be observed during construction of the so-used door panels. Thus, for example, the heat transmission through the lift door must be minimal, wherein the door panel shall withstand a large and, in particular, canted mechanical load at one side. Known door panels (cf DE 19645517) used for lift doors have been formed from two walls, i.e. a front wall and back wall, which are welded together. Through one or more bent profile to members of the back wall an air space between the front wall and back wall is maintained, which ensures a sufficient heat-shielding property.

The connection of the two walls is carried out by spot welding in corresponding inset locations, so that the least possible contact of the two oppositely-disposed walls is produced by the connection.

The rigid connection of the front wall with the back wall does indeed ensure on the one hand a permanent rigidity, but in the case of the heating of door panel, for example in the case of fire, the door panel is warped by different heat expansions predominantly due to temperature difference between the front wall and back wall. The warping of a lift door in the case of fire hampers the opening of the door which may be jammed due to the warping and thus represents a certain risk to safety. Moreover, maximum permissible gap widths, which are prescribed for the purpose of preventing breakthrough of flame, may be exceeded.

BRIEF DESCRIPTION OF THE INVENTION

The object of the invention is therefore to provide a door panel which satisfies all requirements for rigidity of a lift door with respect to mechanical loading, running smoothness and sound transmission while avoiding the above-mentioned disadvantages.

The foregoing and other objects and purposes are met by a door panel according to the invention in which connecting means are provided between the front wall and back wall which release under the action of heat. In addition, at least one heat-resistant connection is provided.

The heat-resistant connection ensures that the lift door panel does not fall apart in the presence of heat and fire and thus remains able to be manipulated as an entirety, while the connection which is releasable under the action of heat between the front wall and back wall enables a relative movement between the two walls in the case of fire. Warping under the action of heat is thereby avoided as would be the case, due to different heat expansion, with a rigid connection over the entire area of the door panel.

A lift door constructed with door panels according to the invention accordingly cannot jam to the extent that is the case with conventional doors so that an easier manipulation is made possible and the permissible gap widths are not exceeded in the case of fire.

Preferably, the heat-resistant connection is arranged at an edge region of the door panel, which is not visible in the installed state of the lift door. Such an arrangement provides an improved appearance of the lift panel at its visible surfaces in comparison with known door panel constructions. Previously used weld points, for example, are difficult to conceal without costly further processing.

In an advantageous development of the invention an area gluing is provided for realizing the heat-releasable connection. The area gluing offers advantages with respect to production engineering, while properties can be realized which were previously able to be achieved only by weld points distributed over the area of the door panel, without large points of contact of the front wall and back wall. A corresponding high overall rigidity of the door panel overall can be achieved by way of the corresponding area connection created by the area gluing. The gluing moreover enables, through the use of an appropriate material between the two walls of the door panel, good sound and vibration damping with an area connection, without the front wall and back wall being in direct contact. Furthermore, a cold production process for construction of the door is possible with the assistance of a gluing step; the results of the gluing is a flat, largely distortion-free door panel which requires at the most minimal further processing.

In a particular embodiment of the invention the heat-resistant connection can be formed to be flexible to a certain extent. This enables, even with such a heat-resistant connection, a relative movement to compensate for different thermal expansions. Such a flexibility is possible in accordance with the invention, as the requisite high rigidity of the door panel can be substantially insured by the additional heat-releasable connection, such as the area gluing. Usual connecting means, such as rivets, screws, detent connections, spot welds or the like can be used for the heat-resistant connection.

Advantageously, the door panel according to the invention may be constructed to be merely double-skinned. The production and stockholding not only with respect to the variety of parts, but also with respect to the assembly of the door panel, are thereby substantially simplified over conventional door constructions.

Advantageously, an upper mounting, by means of which the door panel is able to be fastened to a suspension carriage, may be provided. By means of such a suspension carriage the door panel can be displaced in a guided manner in lateral directions, so that, for example, a telescoping lift door can be constructed from several door panels traveling adjacent to or into one another.

In a particularly advantageous embodiment of the invention the heat-resistant connection between the front wall and the back wall is provided in the region of the upper mounting. This heat-resistant connection can, for example, be combined with the fastening to the suspension carriage. The fastening to the suspension carriage and the connection between front wall and back wall thus can be undertaken with one and the same screw connection Such an arrangement has the effect that, on release of the connection which is not heat-resistant in the case of fire, both front wall and back wall remain fastened in a suspended manner at the suspension carriage.

Advantageously the upper mounting of the door panel is formed by integral shaping of the front wall and/or back wall. The cost in production of the door panel is thereby reduced and, in particular, the above-mentioned double-skinned mode of construction is favored.

The front wall and back wall may be tightened or clamped in the suspension carriage in the region of the upper mounting. The heat-resistant connection between the front wall and back wall is realized by this tightening or clamping in the suspension carriage, while the transverse rigidity of the door panel in the installed state is increased.

Advantageously, at least one bent longitudinal profile member portion is provided in the front wall and/or back wall. Such a bent longitudinal profile member, which can, for example, be made up with a right-angled or trapezium-shaped cross-sectional profile formed by stamping of one or both of the said door panel walls, considerably increases the stiffness of the door panel and can at the same time serve as a spacer between the walls. The bent longitudinal profile member is for that purpose preferably formed to be continuous over the entire length of the door panel so that corresponding bending moments which, for example, act due to mechanical loading in the middle region of the door panel are fully dissipated into the edge regions without weak points.

Advantageously, at least one bent transverse profile member, which at least partly engages over the bent longitudinal profile member, is provided in the edge region. Support of the bent longitudinal profile member on the transverse profile member thereby results upon the occurrence of bending stresses in the door panel and provides a further improvement of resistance to such stresses through improved bending stiffness.

Both the bent longitudinal profile member and the bent transverse profile member can, just as the above-mentioned mountings, be stamped into the front wall and/or back wall in a single working process. Particularly in the case of a double-skinned mode of construction there thus results particularly favorable production costs, as the two metal sheets used for formation of the front and back walls or back wall need only to be shaped in one stamping tool and subsequently be connected together.

In a further advantageous embodiment of the invention the connection which is not heat-resistant, for example the gluing, is carried out along the bent longitudinal profile members. The bent longitudinal profile members not only advantageously increase the rigidity of the door panel according to the invention, but at the same time bridge over the spacing between the front wall and the back wall, so that at such locations a connection is also possible in the middle region of the door panel without costly additional steps or elements. An air space, which has a heat-insulating and sound-insulating effect, remains as before in the intermediate spaces between the bent longitudinal profile members.

In the case of a rectangular or trapezium-shaped cross-section of the bent longitudinal profile member a comparatively large-area, longitudinaly-extending adhesion between the two door panel walls is possible along the transverse web of this bent longitudinal profile member. In addition, a further transversely-extending gluing can be carried out in the edge region, for example in the region of a bent transverse profile member, as explained above, in order to further improve the rigidity of the door panel.

The gluing can be undertaken continuously over the entire bent longitudinal profile member and, as in contrast to the previously usual spot welds, a material can be used for the gluing by means of which the desired properties, such as the desired vibration-damping or sound-damping and the requisite heat insulation, are able to be realized even with a comparatively large-area connection, while the large-area construction particularly makes possible a corresponding rigidity.

Such a gluing can advantageously be realized with the aid of an elastic glue strip. With the aid of such a glue strip, a relatively large amount of material can be applied in the region of the connecting location and subsequently pressed without the comparatively viscous material being displaced during the pressing. With this embodiment, a particularly efficient vibration-damping and sound-damping embodiment can be realized, wherein overall an extremely small stressing between the front wall and back wall is guaranteed. The comparatively large wall thickness of such an elastic glue strip allows corresponding relative movements between the two door panel walls in the glued state and thereby ensures an equalization of stress, wherein a very high stiffness is nevertheless produced.

Spacers with a preferably small contact area between the front wall and back wall may further or alternatively be provided, which spacers can, for example, be stamped in the walls. Spacers of that kind allow, for example, the use of liquid adhesive with subsequent pressing of the front wall and back wall without the liquid adhesive being displaced during the pressing. The spacers produce small, direct contact points between the front wall and back wall, but the contact points can be constructed to be point contacts or area contacts having such small contact area that, as before, no appreciable vibration transmission or sound transmission takes place between the two door panel walls.

The connection between the front wall and the back wall of the door panel may be carried out in such a manner that the cavities disposed therebetween are filled with foam. Apart from a substantial large-area and correspondingly stiff connection, an extremely high sound-damping and vibration-damping capability is generated by the foam-filling of the cavities.

The most diverse commercially available synthetic adhesives may be used as the adhesive for the connection between the front wall and back walls, wherein also future adhesives are, according to the invention, also to be taken into consideration. Thus, for example, acrylate, single or multiple component epoxy resins, single or multiple component polyurethanes, cyanoacrylate adhesives, single or multiple component silicon adhesives and/or so-called single component anaerobic adhesive substances can be used.

Door panels for lift doors are usually provided, apart from the upper mounting at the ceiling side, with a guide at the bottom edge, by means of which they are fastened and guided in the buildings or the lift cages. A further substantial advantage of a lift door panel according to the invention results from the fact that the guide part at the bottom edge and the mounting at the ceiling side can be constructed to be the same. In conjunction with an overall rotationally symmetrical construction of the essential constructional features with respect to a rotation through 180° about a vertical axis, such a door panel can thus be used at the lefthand side and righthand side in a telescoping lift door. For that purpose the door panels are turned each time through 180° according to the respective installation position, according to which the door panels have a mirror-image form about a longitudinal axis. Thus, different lefthand or righthand door panels do not need to be produced. The number of different necessary parts is thus reduced, wherein the number of identically constructed parts is increased, which allows more economic production.

In order to avoid not only the breakdown of two door panel walls of the invention in the case of fire, but also a too great gap formation and the resulting possible penetration of hotter air into the interior of the lift door, several further heatproof connections can be provided in the edge region. These connecting locations are also preferably constructed to be flexible, so that a certain distortion between the two lift walls is possible. This is the case, for example, with the use of rivets in comparatively small number, which do not appreciably stiffen the two-door panel walls relative to one another, but merely stitch them together.

The front side panel is preferably made of a material with the desired appearance, for example from a stainless steel sheet. As may be desired, an appropriate covering or an appropriate coating can be applied, whereas on the rear side, which may not be visible in a telescoping door, a correspondingly cheaper steel is usable.

BRIEF DESCRIPTION OF THE DRAWINGS

An illustrative embodiment of the invention is set forth in the annexed drawings and explained in more detail in the following description by reference to the figures, wherein.

DETAILED DESCRIPTION OF THE INVENTION

Figure 1:
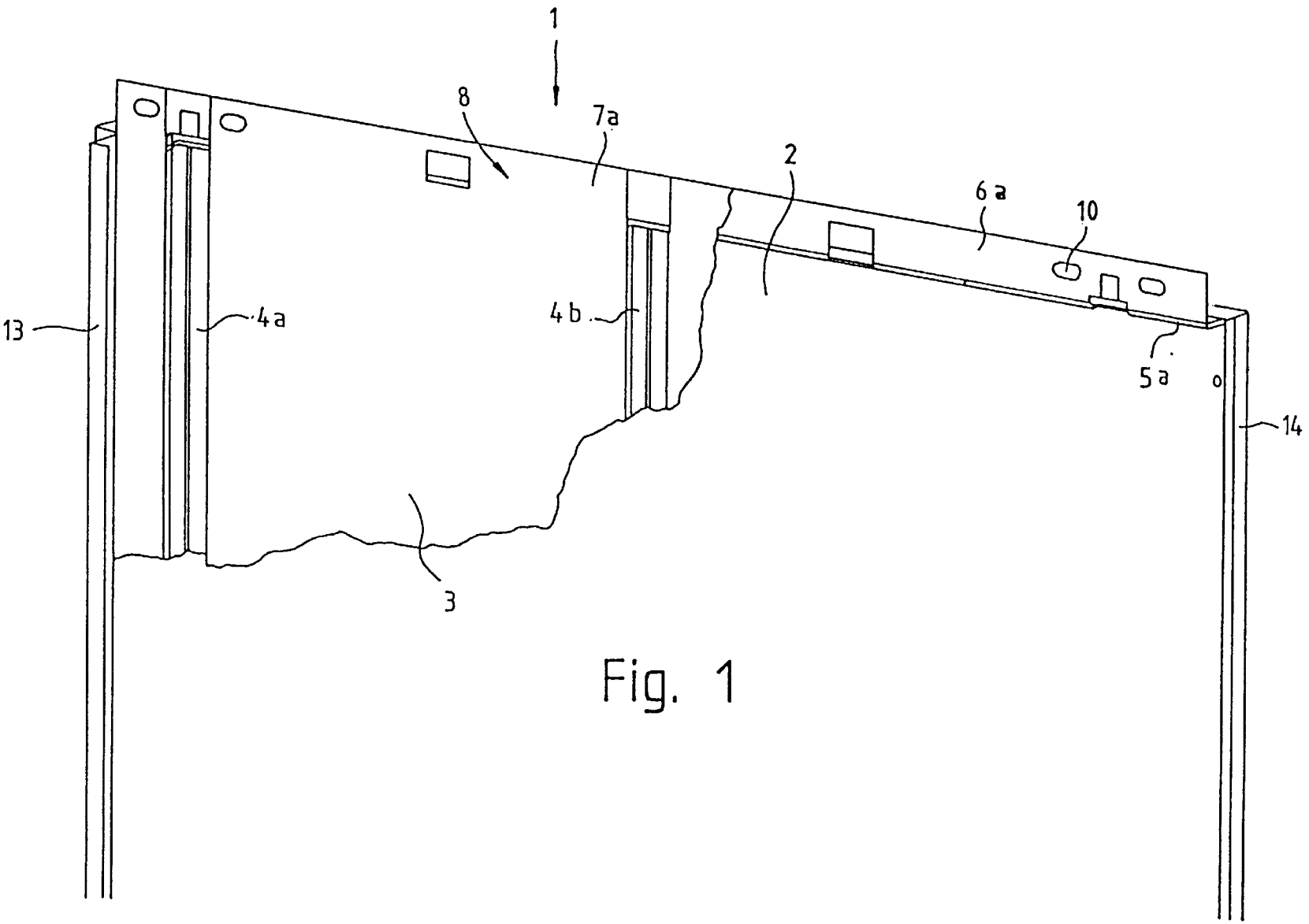
FIG. 1 is a detail of a perspective illustration of the top portion of a door panel according to the invention taken from the rear side thereof.
Figure 2:
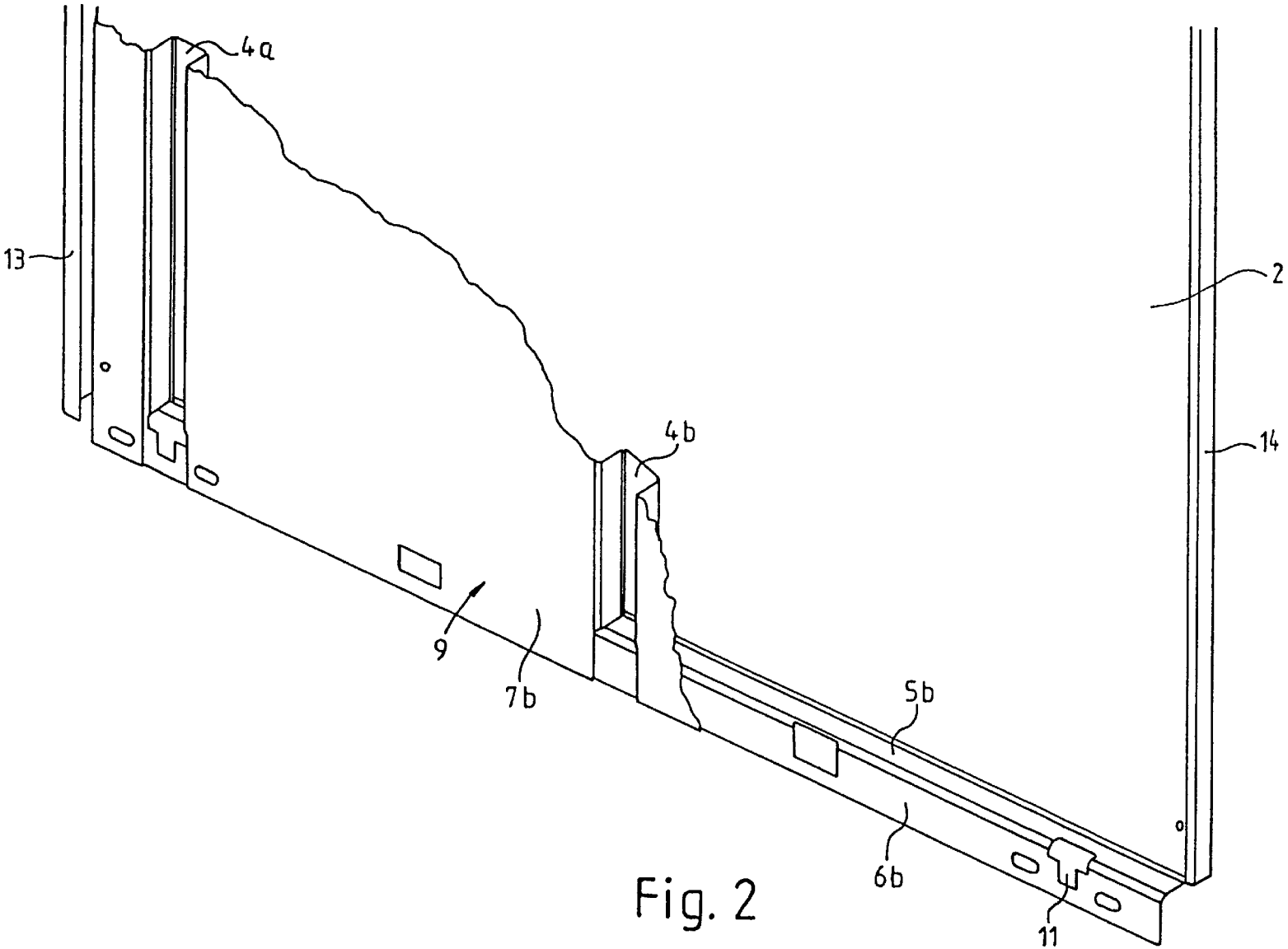
FIG. 2 is a detail of a perspective illustration of the bottom portion of the door panel of FIG. 1 according to the invention.

The door panel 1 according to FIGS. 1 and 2 consists of a front wall 2 and a back wall 3, the back wall being illustrated only in the righthand upper and lefthand lower corner regions respectively of the door panel 1, the remainder of the back wall being removed to allow depiction of the underlying elements.

The back wall 3 includes three bent longitudinal profile member portions 4*a, b, c*, of which in FIG. 1 only the profile members 4*a, b*, and in FIG. 2 only the profile members 4*b, c* can be partially seen. The front wall 2 has at its upper edge a bent transverse profile member 5*a* as seen in FIG. 1 and at its lower edge a bent transverse profile member 5*b* as seen in FIG. 2, which are constructed to be identical and engage over the respective ends of bent longitudinal profile members 4*a, b, c.*

The top and bottom of front wall 2, are provided with a respective flange 6*a*, 6*b*, while top and bottom of back wall 3 are provided with a respective extension portion 7*a, b*, aligned with the front wall flanges 6*a*, 6*b*. The respective flanges and extensions form an upper mounting 8 and lower guide 9 for the door panel 1. Screw holes 10 are provided in the mounting 8, by means of which the mounting 8 can be screw-connected in a suspension carriage and thus clamped in place. The front wall 2 and the back wall 3 are thereby heat-resistantly connected together at the same time. Appropriate cut-outs 11 are also provided in the lower guide 9, for the detenting of slide or roller elements, which are not illustrated.

Figure 3:
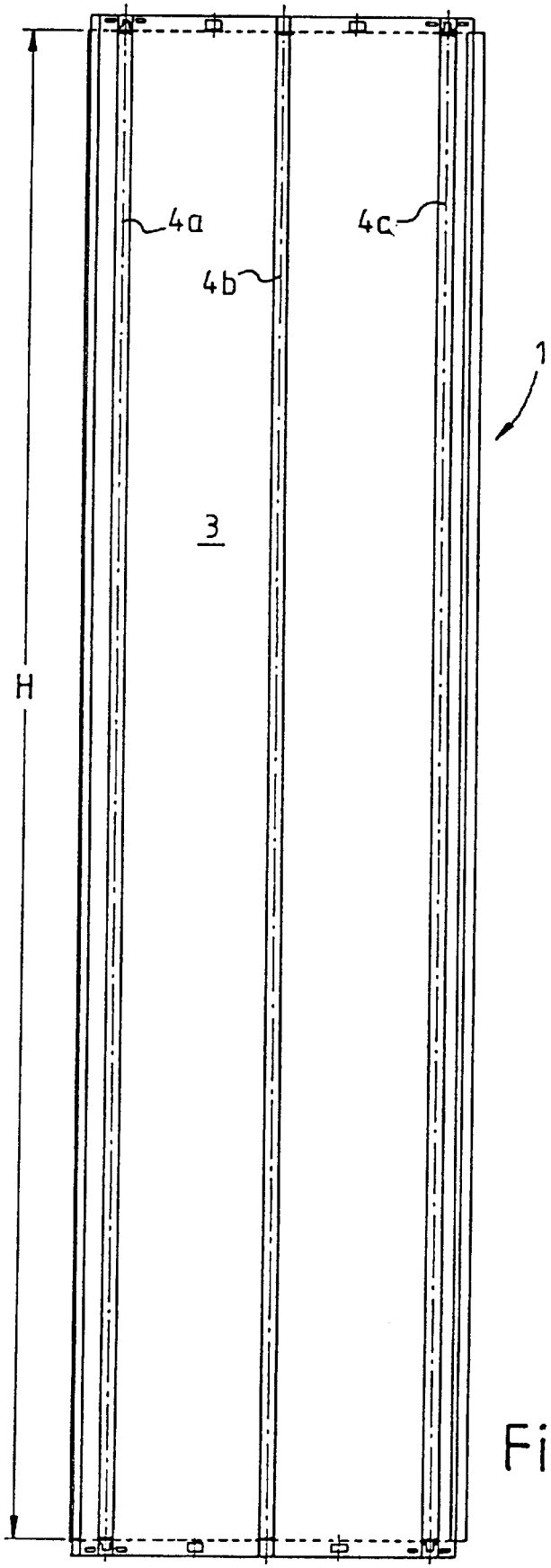
FIG. 3 shows a rear elevation view of a full door panel according to the invention.

The flanges 6*a, b* and extensions 7*a, b* are constructed identically at the top and bottom. Moreover, the bent longitudinal profile members 4*a, b, c*, just as the entire construction of the door panel 1, are constructed to be rotationally symmetrical with respect to a rotation through 180°, so that a door panel according to the invention is usable turned through 180°, i.e. such a door panel is usable not only at the lefthand side, but also at the righthand side in a telescopic door without further constructional measures. It is particularly recognizable in FIG. 3 that the bent longitudinal profile members 4*a, b, c* are stamped into the back wall 3 continuously over the entire length or height H of the lift door, whereby a high stiffness in bending results.

Figure 4:
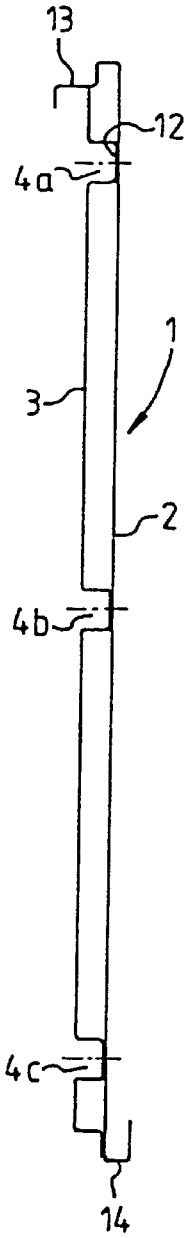
FIG. 4 is a top plan view of a door panel according to the invention.

In the top plan view of FIG. 4 it is recognizable that the bent longitudinal profile members 4*a, b, c* have a substantially rectangular cross-section, so that the transverse webs 12 thereof reach into the vicinity of the front wall 2, whereby, as further explained below, the fastening between the back wall 3 and the front wall 2 can be carried out particularly well at those locations.

Furthermore, it is recognizable in this view that through lateral flanging of the front wall 2, entraining profile member portions 13, 14 can be formed at the side edges of the wall by means of which adjacent door panels 1 can be suspended in or to one another. In the case of a pull at one such door panel of a telescoping lift door the adjacent suspended door panel is thus entrained and moved.

Figure 5:
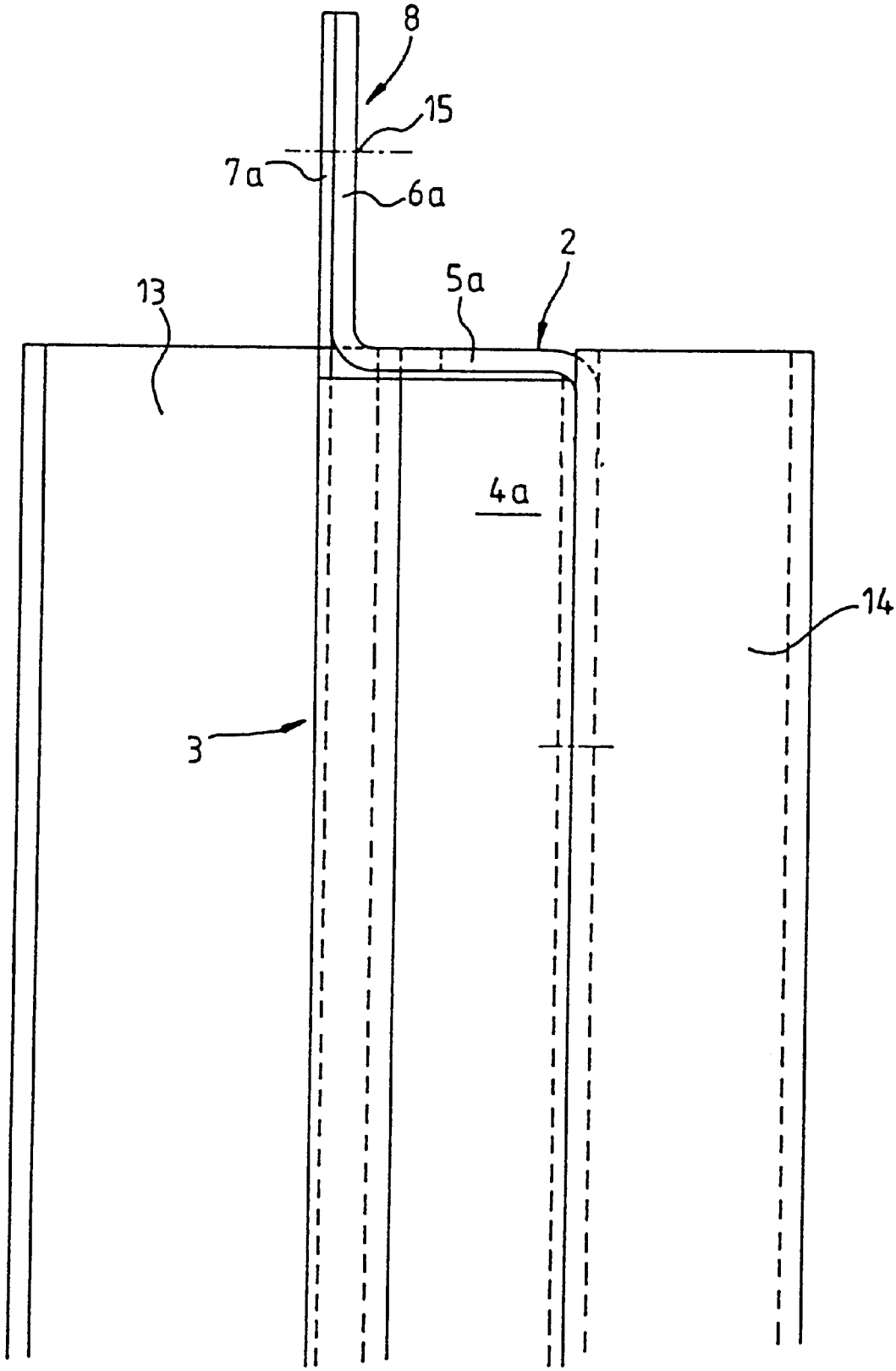
FIG. 5 is a partial side view of an upper portion of a door panel according to the invention.

In the side view according to FIG. 5 it is readily recognizable, apart from the entraining profile members 13, 14, how the upper bent transverse profile member 5*a* of the front wall 2 may be formed integral therewith and engages over the top of the corresponding bent longitudinal profile member portion 4*a* of the back wall 3. The formation of the mounting 8 by the flange 6*a* of the front wall and the extension 7*a* of the rear wall is equally readily recognizable in this illustration.

A connecting location 15 for a heat-resistant connection, for example a screw-connection in a suspension carriage (not illustrated) is shown by dot-dash lines. It is readily recognizable in FIG. 5 that due to the connection of the front wall 2 with the back wall 3 at this location the two door leaf walls remain suspended together in the suspension carriage even in the case of a loosening of the other connecting locations and thus the door leaf still can be correspondingly actuated, i.e. displaced laterally.

Figure 6:
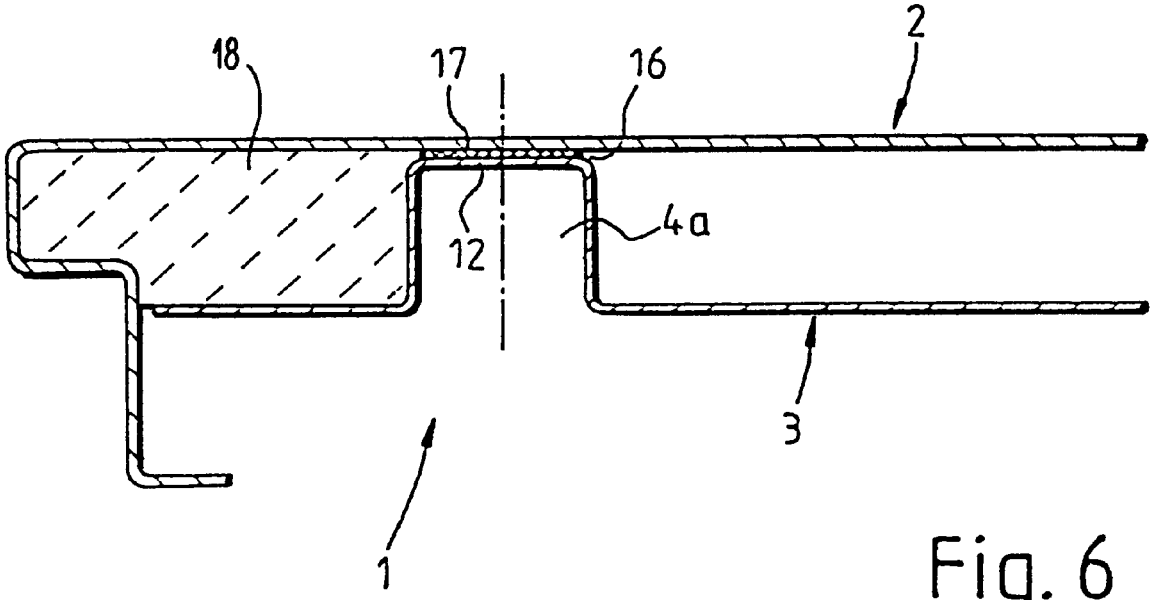
FIG. 6 is a detail of a cross-section through a door panel according to the invention.

In the detail cross-section of FIG. 6 there is apparent through the enlarged illustration the advantageous arrangement of a glue location 16 in the region of the transverse web 12 of a bent longitudinal profile member portion 4*a*. A glue strip 17 of elastic material bridges over the remaining residual spacing between the front wall 2 and the transverse web portion 12.

The glue locations 16 and the glue strips 17 thereat extend substantially over the entire width of the transverse webs 12 of the bent longitudinal profile members 4*a*–4*c* and also over the entire length thereof. A large-area adhesion with corresponding rigidity of the door panel 1 thereby results. At the same time a sufficient quantity of elastic and thus vibration-damping and sound-damping and heat-insulating adhesive material can be introduced between the front wall 2 and the back wall 3. A very low sound transmission between the front wall 2 and the back wall 3, as well as a good thermal insulation of the door panel in the transverse direction, thereby results without the need for additional insulating materials. The front wall 2 directly contacts the back wall 3 solely at the upper and lower edges through the flanges forming the mounting 8 and the guide 9. If desired, however, additional insulating materials, such as foam 18, can be introduced to fill or partially fill spaces between the front and back walls.

By gluing the front and rear walls together, a production procedure utilizing cold pressing of the front wall 2 to the back wall 3 is possible. Substantially less stresses in the door panel 1 thereby result than with welding. Any small residual stresses possibly caused by the pressing can, moreover, be compensated for by the elastic nature of the glue strip 17. Thus, a distortion-free, precisely fitting and highly rigid construction for the lift door panel with little need for later processing, results.

Due to the high dimensional accuracy retained by such a door panel, very small gaps between individual door panels are possible in the production of multi-panel lift doors. Due to the area adhesion in conjunction with the longitudinal profile members 4*a, b, c* as well as the bent transverse profile members 5*a, b* which engage over the longitudinal profile members an extremely high stiffness results, which can satisfy all regulatory requirements.

As a result of the common suspension of the front wall 2 together with the back wall 3 in the mounting 8 in the suspension carriage, there exists a heat-resistant connection which ensures that both the front wall 2 and back wall 3 remain displaceably suspended in the suspension carriage even in the case of fire.

While the front and back walls can remain displaceably suspended in case of fire, the glue location 16 can be released by melting of the glue strip 17. Any distortion, similar to that of a bimetal of the lift door panel 1, is constrained under such high heat effects, so that the lift door formed from door panels 1 according to the invention can still be opened, even after greater heat action, by mutual displacement of the lift door panels 1.

The entire door panel 1 is formed from two stamped parts, which form the front wall 2 and the back wall 3 and the profile members associated therewith. The manufacture of the door panel 1 is thereby possible with very low cost. The shaping of the front wall 2, as well as the back wall 3, i.e. the appropriate flangings or bendings to form the profile member portions as well as the associated punchings, can be undertaken in a single working step.

According to respective requirements, further heat-resistant connections, for example rivets, beyond the illustrated heatproof connection in the mounting 8 can be formed in the edge region of the door leaf 1 for the stitching or joining of the front wall 2 to the back wall 3. This additional fixing, which in the case of the illustrated shapes can be formed, for example, in the region of the entraining profile member 14, can assist in substantially preventing gap formations by spreading apart of the front wall 2 relative to the back wall 3 in the regions spaced from the mounting 8. Such gap formation is to be avoided, as hot gas could penetrate into the intermediate space through corresponding gaps and thus create a corresponding heat feed over the front wall 2. As the lower guide 9 is guided at both sides by a guide rail (note shown), a corresponding spreading apart in the region in the vicinity of the door bottom can similarly be avoided insofar as, for example, usually present profile rails engaging around the guides 9 are positioned to run correspondingly tightly against the guides 9. The associated slide or rolling elements can be constructed to be correspondingly heat-resistant.

A lift door formed from door panels 1 according to the invention gives rise to a low production cost and guarantees a good sound insulation and heat insulation and a very high stiffness, wherein in addition a significant improvement of safety in the case of fire is ensured. Such a construction is possible in which the visible surface of the front wall 2 is not impaired in its appearance by fastening measures, as is the case with spot welds and conventional door constructions.

We claim:

1. A lift door panel having a metal front wall and a metal back wall, the front and back walls being joined by heat-releaseable connecting means to allow relative movement between the front and back walls at an elevated temperature, and at least one heat-resistant connection between the front and back walls to maintain the door lift panel as a unitary entity at the elevated temperature.

2. The lift door panel according to claim 1, wherein the heat-resistant connection is arranged in an edge region of the door panel which is not visible in the installed state of the lift door.

3. The lift door panel according to claim 1 or 2, further including an upper mounting for the fastening of the door panel in a suspension carriage.

4. The lift door panel according to claim 3, wherein the heat-resistant connection is provided in a region of the upper mounting.

5. The lift door panel according to claim 1, wherein the door panel is of a double-skinned construction consisting of the front wall and the back wall.

6. The lift door panel according to claim 3, wherein the upper mounting integrally forms part of at least one of the front wall and the back wall.

7. The lift door panel according to claim 3, further comprising means for clamping the front wall and the back wall in the suspension carriage.

8. The lift door panel according to claim 1, wherein at least one bent longitudinal profile member is provided in at least one of the front wall and the back wall.

9. The lift door panel according to claim 8, wherein the bent longitudinal profile members are formed to be continuous over an entire length of the door panel.

10. The lift door panel according to claim 8, wherein a bent transverse profile member which at least partially engages over the bent longitudinal profile members is provided at an edge side of the door panel.

11. The lift door panel according to claim 8 or claim 9, wherein gluing is provided along the bent longitudinal profile member as the heat-releasable connecting means.

12. The lift door panel according to claim 11, wherein the gluing is formed to be continuous over the entire length of the bent longitudinal profile member.

13. The lift door panel according to claim 1 or claim 8, wherein spacers are stamped into at least one of the front wall and the back wall.

14. The lift door panel according to claim 1 or claim 8 further comprising a cavity formed between the front wall and the back wall and foam at least partially filling the cavity.

15. A lift door panel according to claim 1 or 8, wherein the door panel is constructed to be rotationally symmetrical with respect to a rotation through 180°.

* * * * *